United States Patent [19]

Biagiotti

[11] Patent Number: 4,909,492

[45] Date of Patent: Mar. 20, 1990

[54] FEEDING AND CUTTING CYLINDER WITH SUCTION-OPERATED, SLIDING SHUTTER FOR WEB REWINDING MACHINES

[76] Inventor: Guglielmo Biagiotti, Via de Vorno, 105 Capannori, Lucca, Italy

[21] Appl. No.: 236,471

[22] Filed: Aug. 25, 1988

[30] Foreign Application Priority Data

Sep. 1, 1987 [IT] Italy ..... 9476 A/87

[51] Int. Cl.[4] ..... B65H 3/08

[52] U.S. Cl. ..... 269/21

[58] Field of Search ..... 226/7, 97, 95, 93; 156/538, 554; 271/90–93, 102, 103, 132, 135, 143, 112, 99; 269/21; 294/64 R, 65; 83/451, 925 CC, 402

[56] References Cited

U.S. PATENT DOCUMENTS

| | | | |
|---|---|---|---|
| 2,753,181 | 7/1956 | Anander | 269/21 |
| 3,767,097 | 10/1973 | Watts et al. | 269/21 |
| 3,957,263 | 5/1976 | Christl | 269/21 |

*Primary Examiner*—Robert C. Watson

*Attorney, Agent, or Firm*—Francis J. Bouda

[57] ABSTRACT

A web-feeding and cutting cylinder for rewinding machines, especially in the paper-manufacture industry, includes a suction-operated retention means which temporarily retains, on the cylinder surface, at least one end of the cut web. In the cylinder is a linear, ribbon-like shutter, extending parallel to the axis of the cylinder. It is axially movable and has orifices which cooperate with orifices in the bed or surface on which the shutter slides. This arrangement opens and closes a communication between a vacuum cavity inside the cylinder and the cylinder surface, with a limited displacement of the shutter.

10 Claims, 5 Drawing Sheets

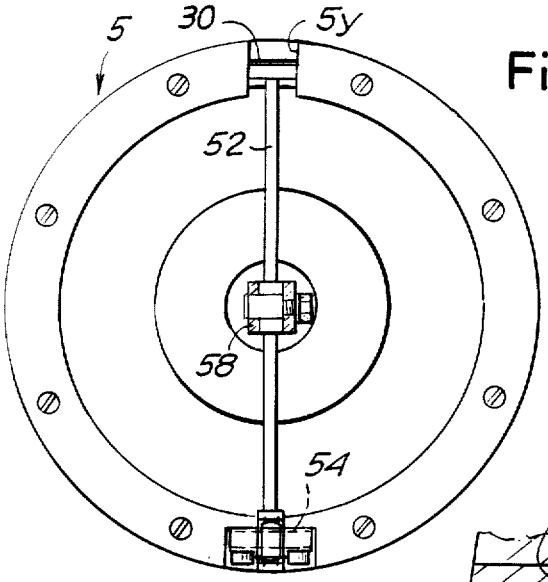
Fig. 2
Fig. 3
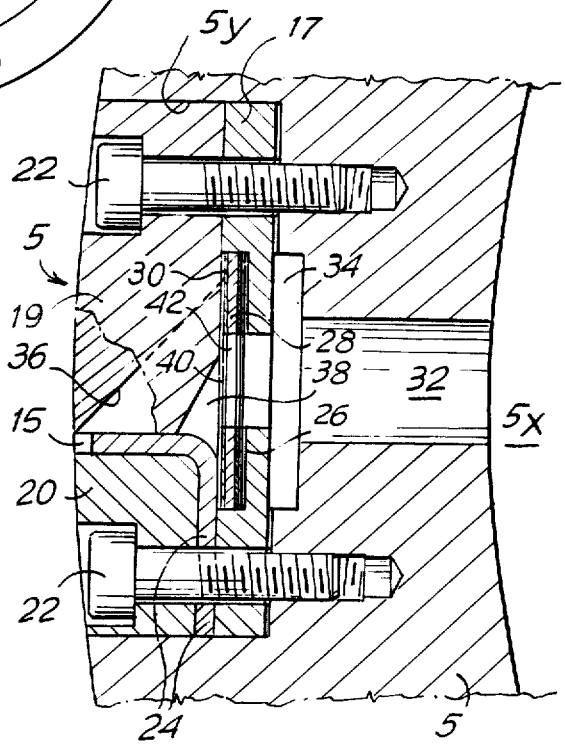
Fig. 4
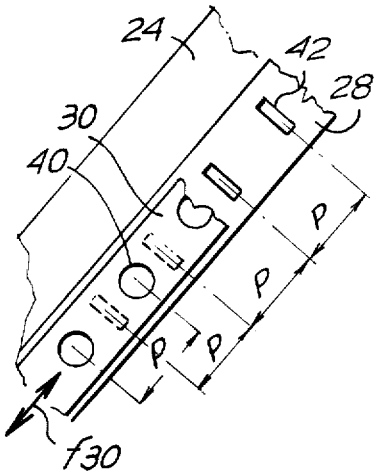
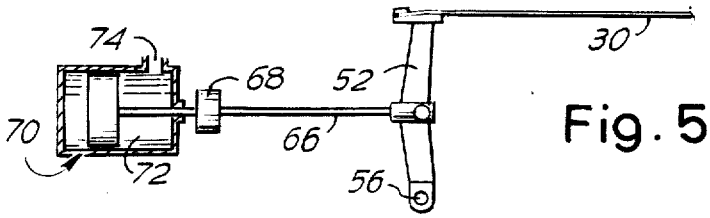
Fig. 5

FEEDING AND CUTTING CYLINDER WITH SUCTION-OPERATED, SLIDING SHUTTER FOR WEB REWINDING MACHINES

BACKGROUND OF THE INVENTION

The invention refers to an improvement in the machines for paper manufacture and, in particular, but not exclusively, to machines for rewinding small rolls from big rolls.

In the paper-making industry, and particularly in the manufacture of kitchen towels in roll form and toilet paper in roll form, the extremely large rolls of webs of paper which are made on a paper machine must be converted to the smaller size roll, and this is usually done "off machine" on a re-winding machine which operates at high speed and produces a plurality of the smaller rolls wound on a cardboard tube or core. Such a rewinder generally comprises a continuously rotating cylinder, which advances and controls the web material, as well as cuts the web when a log or roll of paper wound on a core has been completed and when the winding on another core must begin.

When the cutting of the web takes place across the cutting arc of the advancement cylinder, it is necessary to temporarily retain the ends of the web at least in the zone adjacent to the cut. This must be carefully timed in order to control the web during the advancement and to release it in time (upon the completion of the last turn of a previous roll or log) at the beginning of the winding of a new roll or log on another core. At this instant, it is necessary to release the paper end so as not to interfere with the winding of the new roll.

Pneumatic-operated suction systems to retain the light web of paper are well known. It is necessary to control the suction with precise timing during a predetermined phase of the rotation cycle of the cylinder, when the core replacement and a new winding is to take place. The prior means cause significant construction difficulties and, in particular, significant difficulties in the maintenance and in the changes on the cylinder, with significant lost production time and complications in the machine adjustment both during the removal of the cylinder and during the re-assembly of same cylinder after the changing.

OBJECTS OF THE INVENTION

The present invention overcomes these drawbacks by providing a cylinder with a special pneumatic suction system for the web retention control without any need of disassembling the cylinder from the machine during down-time for checking, maintenance and repair operations. In this way, down-times and changing difficulties and also the need of highly skilled operators for such devices are avoided.

These and other objects and advantages will be evident to those skilled in the art by a reading of the following text.

SUMMARY OF THE INVENTION

In the cylinder of the present invention, the web retention means (which must rapidly be made inoperative, along the cylinder periphery path to allow the beginning of the winding of the initial end of the web over a newly inserted core), comprises a linear shutter, preferably ribbon-shaped, extending parallel to the cylinder axis and axially movable. It has orifices which cooperate with orifices of a bed, that is a surface, for the sliding of said linear shutter in order to open and close a communication between a vacuum cavity inside the cylinder and the surface of same cylinder, all done with a very small displacement of said linear shutter.

Control means for the sliding of the shutter may comprise a pulling or traction means at each end of said linear shutter, able to selectively exert a pull against a counteracting force. This creates a rapid oscillation of the shutter in opposite directions.

The orifices of the shutter, which has a laminar shape, may be of wide, mostly circular cross-section, and the cooperating orifices of the bed on which the shutter slides may be shaped in the form of slots substantially disposed in a transversal direction with respect to the direction of motion of the shutter.

The drive means may be arranged so as to cause a sliding of the shutter during more than one cylinder revolution.

In one embodiment, each of said pulling or traction means is located outside the cylinder and beyond the concerned end, and includes a mechanical transmission located in the cylinder shaft. A lever, diametrally disposed in the cylinder, has a moving end which engages the shutter and exerts a pull thereon. The other lever end is pivoted to the cylinder.

One embodiment of the pulling means comprises, on one side, a cylindrical cam synchronously movable with the cylinder and with a channel profile substantially having a plurality of continuous turns for an axial operation. On the other side is a lever feeler than can be driven by said channel and a mechanical linkage transmission developing from said lever feeler up to the lever diametrally disposed in the cylinder. The pulling means also includes a counteracting elastic means and means for the neutralization and activation of the feeler to move it away from and draw it close to the channel cam. These means are controlled by a pre-set program.

The counteracting elastic means may include a pneumatic cylinder-piston system, powered by air under limited pressure and with an exhaust having a calibrated opening, so that the displacement performed by the cam member on said cylinder-piston system causes an accumulation of pressure elastic potential energy that is progressively reduced during the return cycle, due to the counteracting effect.

The means for the suction-operated retention of the web at the surface of the cylinder may be a channel of adjustable width and communicating with the shutter through passages and a manifold of limited volume.

The cam may be shaped so as to provide maximum speed at the shutter closing point so as to obtain a rapid release of the web.

With the above and other objects in view, further information and a better understanding of the present invention may be achieved by referring to the following detailed description:

DETAILED DESCRIPTION

For the purpose of illustrating the invention, there is shown in the accompanying drawings a form thereof which is at present preferred, although it is to be understood that the various instrumentalities of which the invention consists can be variously arranged and organized, and that the invention is not limited to the precise arrangement and organizations of the instrumentalities as herein shown and described.

In the drawings, wherein like reference characters indicate like parts:

FIG. 2 is a section of line II—II of FIG. 1.

FIG. 3 is an enlarged section of the shutter on line III—III of FIG. 1.

FIG. 4 is a schematic view of the shutter and its holes.

FIG. 5 is a schematic view of the shutter activating means.

Figure 1:
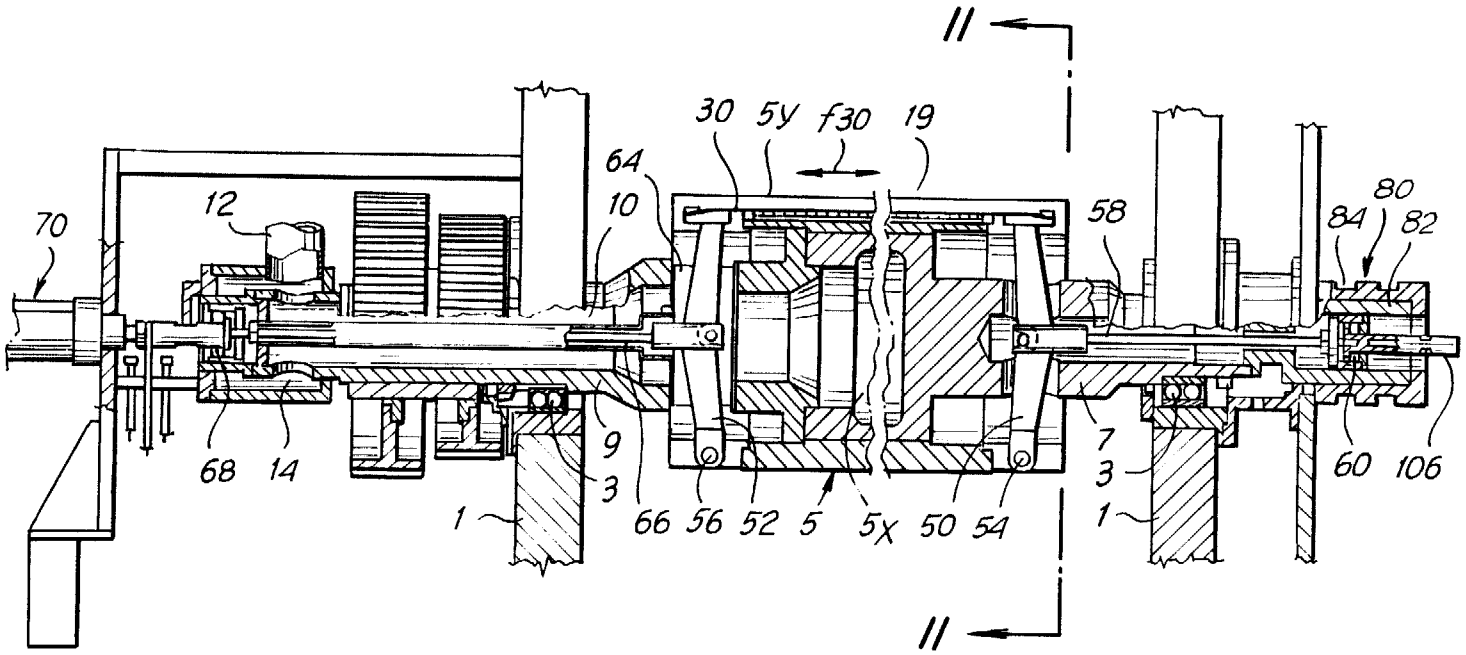
FIG. 1 shows a longitudinal axial cross-sectional view.

Referring to FIG. 1, numeral 1 generally indicates the side members of the machine, e.g., a rewinder, on which side members the cylinder 5 is mounted through bearings 3, for the feeding and the cutting of the paper web. This cylinder has a longitudinal zone (not shown) at its periphery, which is intended to cooperate with an external blade. The blade and zone cooperate to cut the paper web driven around the cylinder 5 and advanced by same cylinder to be subsequently wound on a core for the formation of reels or logs. Around the cutting zone, pneumatically operated suction means are provided for the retention of the web at least at the cutting zone, in order to retain the web until it has to be released (which occurs when the pneumatic suction stops).

Cylinder 5 is supported by two hubs 7 and 9 extending from the same cylinder for the mounting thereof on bearings 3. Hub 9 is hollow, and it has a passage 10 leading to a conduit communicating with a vacuum source through a suitable manifold 14. Passage 10 is in communication with the cavity 5X which is under vacuum inside the cylinder 5.

As shown in FIGS. 2 and 3, longitudinally and adjacent to the cutting zone on cylinder 5, a narrow suction channel 15 is formed for the air suction and the paper retention. This narrow channel 15 is formed by providing a channel 5Y in the cylinder thickness, in which channel 5Y there are disposed a shim 17 (resting on the bottom) and two blocks 19 and 20 secured by screws 22 to the thickness of cylinder 5. A shaped shim 24 is interposed between shim 17 and block 20, said shim 24 defining, together with blocks 19 and 20, said narrow suction channel 15. Changing the shaped shim 24 allows the dimension of channel 15 to be changed, through the possible replacement of one of blocks 19 and 20 in order to vary the width of same channel 15.

Within shim 17, a recess is formed inside which a fixed ribbon-like member 28 is applied, which may be by means of a bi-adhesive element 26 or the like. Against this member 28 a further member 30 is made to rest and can longitudinally slide as it is retained by member 28 on one side, and by block 19 and shim 24 on the other. Members 28 and 30 make up a laminar shutter which extends throughout the length of channel 15 and provides the control of the communication between channel 15 and cavity 5X inside cylinder 5.

The communication takes place through radial holes 32 within the thickness of the cylinder and a manifold recess 34 in the bottom of cavity 5Y on one side of shutter 28, 30. On the other side of shutter 28, 30, the communication with channel 15 takes place through a set of slots 36 formed according to a comb-like arrangement within block 19 and a manifold 38 formed by a longitudinal bevel of block 19. The openings formed on one side of channel 15 by slots 36 can be adjusted through the replacement of shim 24 to provide a more or less deep channel 15 with more or less wide suction openings defined by the bottom of channel 15 and by slots 36.

The laminar shutter 28, 30 is capable of controlling the passage between manifold 34 and manifold 38 through minimum displacements of the movable laminar shutter part represented by member 30. Member 30 has a plurality of orifices 40 equally spaced, one from the other, and mostly circular or, in any case, of relatively wide cross-section and preferably of non-square profile. The fixed member 28 of the shutter has a plurality of orifices 42 formed as slots extending transversally to the direction of longitudinal (axial) displacement of the member 30 of the movable laminar shutter. Orifices 42 are spaced apart the same distance as the spacing of orifices 40. Through the displacement of limited extent of member 30 of the laminar shutter, shown by the double arrow f30 in FIG. 1 (by an amount of the order of magnitude ranging from the interspace pitch P between orifices 40 or 42 and the diametral or longitudinal dimension of orifices 40), it is possible to rapidly obtain an uncovering of the passage between manifolds 34 and 38 and a recovering, i.e., a closing of such passage according to a desired law. It is thus possible to rapidly control the vacuum conditions to be imposed within channel 15 in order to obtain the desired retention effect and the desired timely interruption of this retention effect.

The profiling of orifices 40 and 42 and the law of longitudinal displacement of the member 30 of the laminar shutter provides a desired variation law of the suction effect within channel 15. It should be noted that the volume of the communication cavity between channel 15 and laminar shutter 30, 28 is relatively limited and, therefore, the opening and the closing of the laminar shutter cause a vacuum condition (or a lack of vacuum) almost instantaneously or in any event obtainable in a very short and extremely controlled time interval with respect to the instant of the laminar shutter displacement.

The longitudinal movement in direction of arrows f30, for a relatively short run of the member 30 of the laminar shutter allows thereby a precise control of the phasing and operative cycle of the pneumatically operated suction in channel 15, and of the release of the paper web.

To obtain the movement according to arrow f30 of the member 30 of the laminar shutter, there is provided a dual system for the tensioning and displacement by means of two diametral levers 50 and 52, pivoted at 54 and 56 within suitable diametral seats at the ends of cylinder 5. The movable ends of levers 50, 52, opposite to pivots 54 and 56, are shaped with suitable curved surfaces for the engagement of the ends of member 30, which is made flexible to lie onto said surfaces upon limited angular displacements of same levers 50 and 52.

The two levers 50 and 52 are driven by tension rods coaxial and internal to hubs 7 and 9, through external controls and swivel joints. Controls or actuations are of pulling type for each of said levers and the displacements of the latter are determined in one direction or the other by a counteracting effect. This is accomplished by the control produced onto the lever instantaneously by a force greater than the counteracting one. Lever 50 is positively driven by the effect of an outwardly directed pull created by a tension rod 58 anchored midway along lever 50 and passing inside hub 7.

Tension rod 58 rests in a ball bearing 60 which allows the rotation movement of tension rod 58 engaged with lever 50 which follows the rotation movement of cylinder 5 while the controls outside the ball bearing 60 are independent of the cylinder rotations. The diametral lever 52 is housed in a diametral seat 64, which is isolated with respect to passage 10 providing the communication of the vacuum cavity 5X of the cylinder with the vacuum conduit 12. The isolation of the space under vacuum is completed also by a sheath including a tension rod 66 for the actuation of said lever 52. Also tension rod 66 is connected to a ball bearing 68 for transmitting the external command to tension rod 66 (rotating together with the cylinder).

The drive of lever 52 is operated by a cylinder-piston system 70, intended to ensure a counteracting pulling effect on the member 30 of the laminar shutter and to cause it to return. In particular, the cylinder-piston system 70 (see in particular FIG. 5) has a cavity 72 which is delimited by the piston and the cylinder and which is fed by air under limited pressure escaping through a calibrated orifice 74. When the tension rod 66 is pulled by lever 52, it causes a reduction of cavity 72 and thus a brief and fast increase of pressure inside this cavity, which increase is progressively reduced in a suitably predetermined time through the calibrated escape orifice 74. Accordingly, soon after the return of tension rod 66 by means of lever 52, there is obtained a pneumatic effect of lever 52, which recall effect is progressively reduced to the minimum value pre-established according to the feeding pressure of cavity 72 and the calibration of orifice 74. It is possible to operate a return of lever 52 and thus of the member 30 of laminar shutter immediately after the reverse drive imposed by tension rod 58 and by lever 50 on said member 30 of the laminar shutter with consequent recall of tension rod 66.

The opposite tension rod 58, acting on diametral lever 50, is positively driven for the outwardly directed recall by an assembly which comprises a cam able to determine the recall of the tension rod and thus of the member 30 of laminar shutter during a limited number of pre-determined revolutions of the cylinder. Such number is established according to the number of revolutions of the cylinder and thus to the length of the paper web which is fed and wound around a log or reel, after which the cut must be carried out together with the pneumatic retention operated through the control action on tension rod 68.

FIGS. 9 to 12 show a cam system for the control of tension rod 58.

Figure 6:
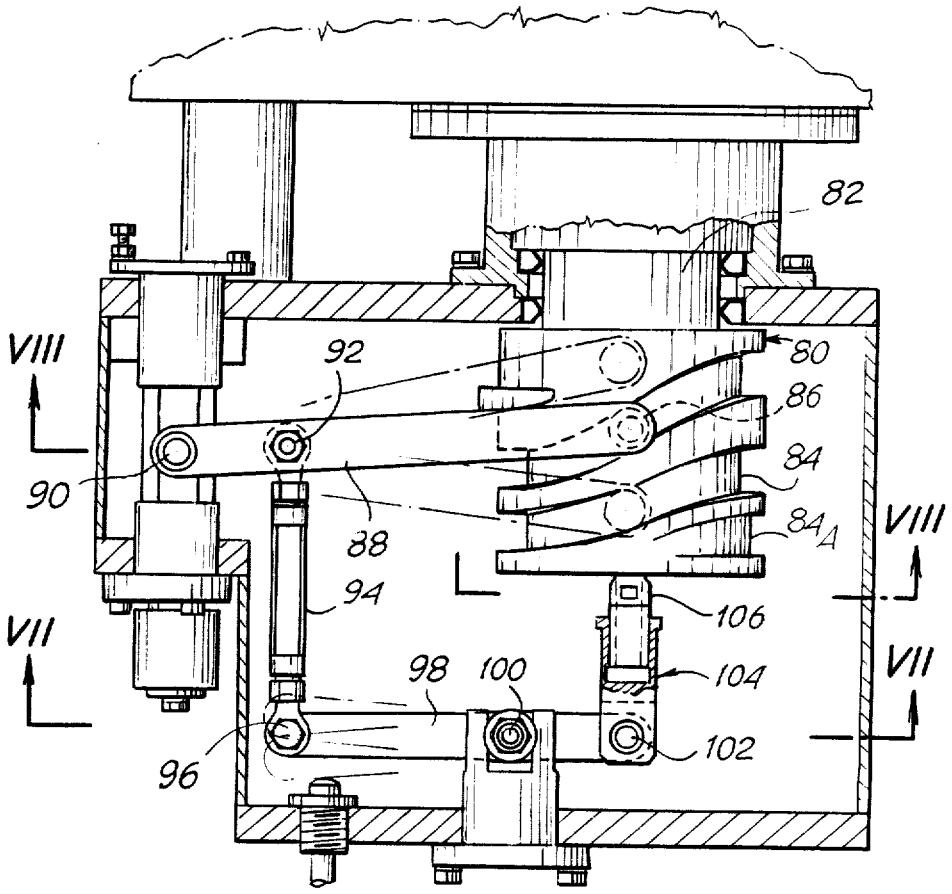
FIG. 6 is a section view of the drive cam arrangement.

A cylindrical cam 80 is firmly secured to the end of hub 7 of cylinder 5 through an intermediate member 82 on which said cam 80 is fixed (see FIG. 6).

Cam 80 (see also details of FIGS. 9 to 12) is provided with a channel 84 having at least two shaped turns and has variable depth. Channel 84 has, in particular, an input 84A with a progressive deepening of channel 84 and with a circle arc development, which then spirals up to an output ramp 84B which also has a progressive reduction of the channel depth. Adjacent the output ramp 84B, a projection 84C is provided, which is disposed alongside ramp 84B. The spiral channel 84 may have a configuration wherein the turns have not a constant inclination, but may be provided instead with curves according to a desired law, in order to obtain a desired law for the displacement of the member 30 of the movable laminar shutter.

A roll feeler (cam follower) 84, carried by an arm 88, is provided for cooperating with cam 80 (rotating, as already mentioned, together with cylinder 5), which follower is capable of performing displacements close to and away from cam 80, as well as displacements orthogonal thereto, that is, parallel to the axis of cam 80. Thus arm 88 is articulated through a knuckle or universal joint 90 which allows these two movements. To arm 88 a rod 94 is connected at 92, which rod is in turn pivoted at 96 on an arm of a rocker lever 98. The arm 98 pivots at 100 on a fixed point and is further connected at 102 to a head 104 connected with a portion of tension rod 106 leading to the swivel joint 60.

Figure 7:
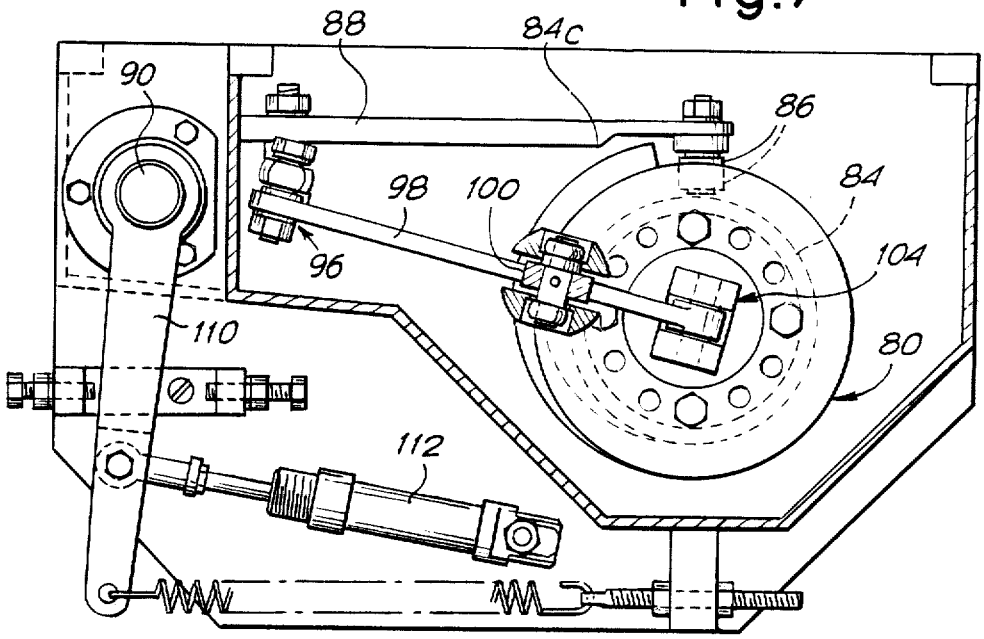
FIG. 7 is a sectional view long line VII—VII of FIG. 6.
Figure 8:
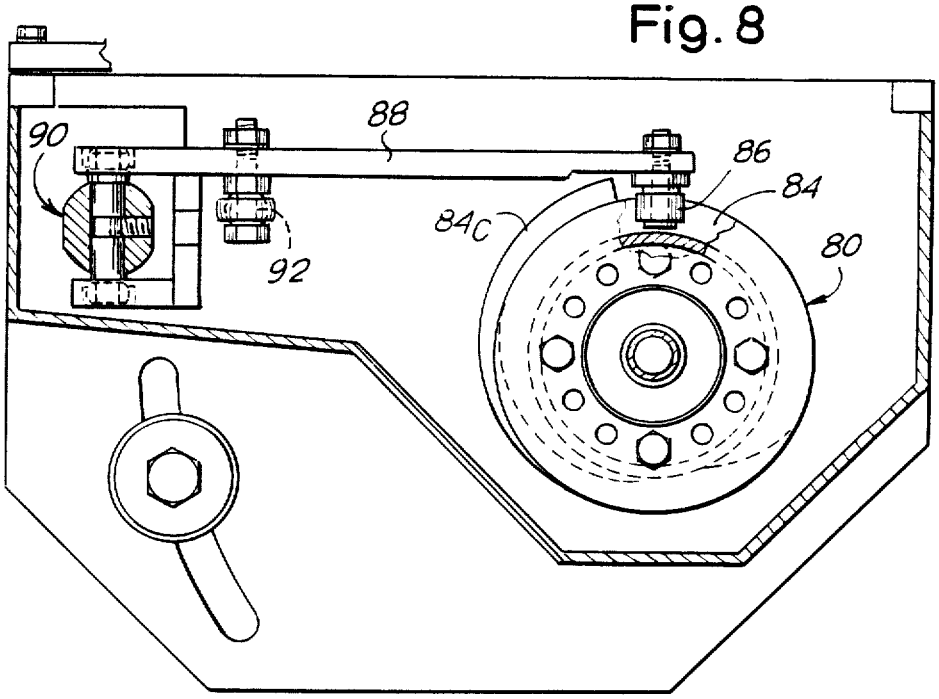
FIG. 8 is a sectional view along line VIII—VIII of FIG. 6.
Figure 9:
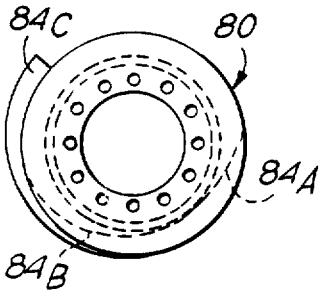
FIGS. 9 to 12 show some details of the drive cam of FIG. 6.
Figure 10:
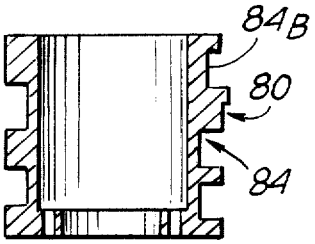
Figure 11:
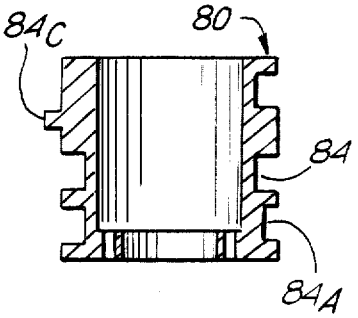
Figure 12:
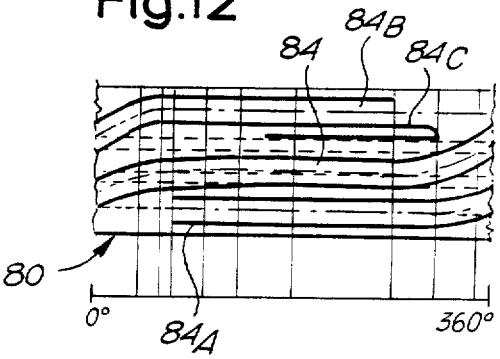

Linkage 88, 94, 98, 104, 106 causes the axial movement of tension rod 58 and then of the member 30 of the laminar shutter according to the actuations or drives imposed on follower 86 by channel 84 of cam 80. The movements of follower 86 close to and away from cam 80 are determined by a lever 110 (see FIG. 7) pivoted at joint 90 and driven by a cylinder-piston system 112 that causes the moving to and fro of follower 86 and, therefore, the intervention and the stopping of the intervention of this follower and of linkage on the laminar shutter. The cylinder-piston system 112 will be timely controlled by a program each time a cut must be carried out, and a suction and retention function performed on the paper web. Cam 80 will cause the displacements of the movable shutter so as to timely provide the suction (and the stopping thereof) in relation to the angular position taken up by the cylinder and corresponding to the angular position of cam 80.

The action of feeler 86 extends over two revolutions (as a consequence of the morphology of cam 80) and, in particular, of its channel 84. With the approach of follower 86, this comes to correspond to the input 84A of cam 80, whereupon the follower penetrates the circumferential length 84A and begins its engagement with the side members or walls of channel 84, thus imposing the displacement law corresponding to the profile of cam channel 84 on linkage 88, 92, 94, 98, 104, 106, 58.

After reaching the output zone 84B, follower 86 is moved out of the cam and comes to rest on side member 84C until said follower leaves such side member and is recalled in alignment with the input 84A. The follower is kept at a distance with respect to the cam owing to the recall effect caused by the cylinder-piston system 112, which timely actuates the arm of lever 110 in a direction opposite to the one through which it had caused the approach of the follower of the cam.

It is thus possible to timely obtain the pulling through the diametral lever 50 on the laminar shutter. The recall operated by the diametral lever 50 causes, through the tension rod 66, the recall of the piston of cylinder-piston system 70, with a consequent sudden reduction of volume 72 and an increase of the pneumatically-operated counteracting effect on tension rod 66. In this way, tension rod 66 causes, in turn, the recall of laminar shutter, that is, of member 30, in a direction opposite to that caused by cam 80, soon after cam 80 has stopped its action. The recall operated by tension rod 66 is gradually reduced owing to the re-expansion of the air cushion within cavity 72 and to the escape which takes place through the calibrated hole 74.

It is thus possible to obtain a system for controlling the suction-operated retention and the stopping of such retention through the laminar movable shutter, which is directly accessible on the cylinder with no need of disassembling the cylinder, while the access to the members outside the cylinder for the cam drive and for the pneumatically-operated counteracting drive are accessible alongside and outwardly of side members 1.

The previously mentioned advantages are thus obtained of avoiding down times and intervention difficulties, which are typical of systems for actuating and controlling the pneumatic retention in the cylinders of presently known machines. A high accuracy in the manufacture is obtained as well.

It is furthermore to be understood that the present invention may be embodied in other specific forms without departing from the spirit or special attributes; and it is, therefore, desired that the present embodiments be considered in all respects as illustrative and, therefore, not restrictive, reference being made to the appended claims rather than to the foregoing description to indicate the scope of the invention.

Having thus described the invention, what is claimed as new and desired to protect by Letters Patent are the following:

1. A feeding and cutting cylinder having a cylinder axis for web rewinding machines able to cooperate with means for the cutting of the web, and provided with suction-operated retention means which temporarily retain on the cylinder surface at least one end of the cut paper, which retention means have to be rapidly neutralized along the path of the cylinder periphery in order to allow the winding of the leading edge of the web on a newly inserted core characterized in that said suction-operated retention means include:

a linear, ribbon-shaped shutter extending parallel to the cylinder axis and longitudinally movable, orifices in said shutter, surface in said cylinder for the sliding of said linear shutter thereon, orifices in said surface which cooperate with the orifices in said shutter in order to shut and open a communication between a vacuum cavity inside the cylinder and the web-retention surface of the cylinder, with a limited displacement of said linear shutter.

2. A cylinder according to claim 1 characterized in that drive means for the sliding of the shutter comprise a tension means at each end of said linear shutter, able to selectively exert a pull which prevails over a counteracting effect, in order to impose short movement in opposite directions of the shutter and obtain opening and closing phases of the orifices.

3. A cylinder according to claim 2 characterized in that the orifices of the shutter, which has a laminar shape, and the cooperating orifices of the cylinder surface, are of wide section the orifices of the cylinder surface being shaped in the form of a slot substantially transverse with respect to the motion direction.

4. A cylinder according to claim 3, characterized in that said drive means are arranged to cause a sliding of the shutter during more than one revolution of the cylinder.

5. A cylinder according to claim 4 characterized in that each of said tension means is located at the outside of the cylinder and beyond the adjacent end thereof, and comprises a mechanical transmission located substantially inside the shaft of the cylinder and, inside the cylinder, a lever diametrally disposed therein to engage the shutter and exert a force thereon through a movable end, the other end of same lever being pivoted on the cylinder.

6. A cylinder according to claim 5 characterized in that one of said tension means comprises: on one side a cylindrical cam member synchronously movable with the cylinder and having a spiral channel extending more that 360 degrees around said cylinder, and on the other a lever follower operable by said channel and a mechanical linkage transmission extending from said lever follower up to the lever diametrally disposed within the cylinder; the other one of said tension means being an elastic counteracting means.

7. A cylinder according to claim 6, characterized in that said cylinder includes neutralizing and activating means of the follower which cause said follower to move away from and toward the cylindrical cam, said means being controlled by a program.

8. A cylinder according to claim 6, characterized in that said elastic counteracting means comprises a pneumatically-operated cylinder-piston system powered by air under limited pressure and with an exhaust, in the form of a calibrated opening whereby the displacement operated by the cam member to said cylinder-piston system causes an accumulation of elastic pressure potential energy which decreases progressively during the return cycle because of the counteracting effect.

9. A cylinder according to claim 1 characterized in that the arrangement for the suction-operated retention at the cylinder surface comprises a channel having adjustable width and communicating with the shutter through passages and a manifold of limited volume.

10. A cylinder according to claim 1 characterized in that the cam is so created as to obtain the maximum velocity at the closing point of the shutter, in order to achieve a fast stopping of the retention effect.

* * * * *